US011890497B2

(12) United States Patent
Holland

(10) Patent No.: US 11,890,497 B2
(45) Date of Patent: Feb. 6, 2024

(54) SPORTS TRAINING LADDER AND HURDLE

(71) Applicant: Quick Play Sport LLC, Santa Clara, CA (US)

(72) Inventor: Allen Holland, Sheffield (GB)

(73) Assignee: QUICK PLAY SPORT LLC, San Diego, CA (US)

( * ) Notice: Subject to any disclaimer, the term of this patent is extended or adjusted under 35 U.S.C. 154(b) by 1242 days.

(21) Appl. No.: 16/310,308

(22) PCT Filed: Nov. 17, 2017

(86) PCT No.: PCT/US2017/062407
§ 371 (c)(1),
(2) Date: Dec. 14, 2018

(87) PCT Pub. No.: WO2018/094274
PCT Pub. Date: May 24, 2018

(65) Prior Publication Data

US 2019/0321674 A1 Oct. 24, 2019

Related U.S. Application Data

(60) Provisional application No. 62/424,379, filed on Nov. 18, 2016.

(51) Int. Cl.
*A63B 17/04* (2006.01)
*A63B 23/04* (2006.01)
(Continued)

(52) U.S. Cl.
CPC ..... *A63B 17/04* (2013.01); *A63B 23/04* (2013.01); *A63B 71/0036* (2013.01);
(Continued)

(58) Field of Classification Search
CPC ..... A63K 3/04; A63K 3/043; A63B 23/04; A63B 71/0036; A63B 2210/00;
(Continued)

(56) References Cited

U.S. PATENT DOCUMENTS 1,044,128 A * 11/1912 Brook ..... A63B 5/02 5/310
3,685,824 A * 8/1972 Quinn ..... A63K 3/043 108/118
(Continued)

OTHER PUBLICATIONS

PCT/US17/62407, International Search Report dated Mar. 9, 2018.
(Continued)

*Primary Examiner* — Gary D Urbiel Goldner
(74) *Attorney, Agent, or Firm* — Katherine M. Bond; Cislo & Thomas, LLP

(57) ABSTRACT

The present invention provides for a hurdle having an upright position and a collapsed position, the hurdle comprises a crossbar and a pair of legs pivotally connected to the crossbar. Each leg has a proximal end and a distal end where the proximal end is pivotally connected to the crossbar end and the distal end is for placement on an exercising surface. The distal ends of the legs can be rotated away from the bottom surface of the crossbar in an expanded upright position. In an upright position the hurdle provides height relative to the exercise surface which can be adjusted by a pivot angle between the crossbar and legs. When the hurdle is in a collapsed position the legs are substantially parallel to the crossbar. In another embodiment the crossbar of the hurdle can be used as a rung in an exercise agility ladder.

5 Claims, 13 Drawing Sheets

(51) Int. Cl.
*A63B 71/00* (2006.01)
*A63K 3/04* (2006.01)

(52) U.S. Cl.
CPC ..... *A63K 3/043* (2013.01); *A63B 2210/50* (2013.01); *A63B 2225/093* (2013.01)

(58) Field of Classification Search
CPC ..... A63B 2210/50; A63B 2225/09; A63B 2225/093; A63B 2244/08; A63B 2244/088
See application file for complete search history.

(56) References Cited

U.S. PATENT DOCUMENTS 5,033,737 A * 7/1991 Moye ..... A63K 3/043 248/164
5,199,930 A * 4/1993 Weber ..... A63K 3/043 248/164
6,447,427 B1 9/2002 Myrland et al.
7,611,442 B1 3/2009 Myrland
7,785,233 B1 * 8/2010 Moore ..... A63K 3/043 482/17
9,039,575 B2 * 5/2015 Holland ..... A63K 3/043 482/17
9,427,677 B1 * 8/2016 Bray ..... A63K 3/043
9,675,830 B2 * 6/2017 Holland ..... A63B 69/00
2008/0020903 A1 1/2008 Dieter
2011/0166000 A1 7/2011 Wight
2014/0287878 A1 * 9/2014 Holland ..... A63B 5/22 482/17
2015/0224379 A1 * 8/2015 Holland ..... E06C 1/52 482/51
2016/0045839 A1 * 2/2016 Holland ..... A63K 3/043 482/17
2017/0246523 A1 * 8/2017 Holland ..... E06C 1/52
2018/0099171 A1 * 4/2018 Chen ..... A63B 6/00
2018/0193683 A1 * 7/2018 Barr ..... A63B 5/22
2019/0366179 A1 * 12/2019 Holland ..... A63B 71/03

OTHER PUBLICATIONS

Quickplay Sport. QuickPlay Speed Ladder—No More Tangle or Twisting. YouTube. Nov. 3, 2016. https://www.youtube.com/watch?v=hPlvwUQm8qA.
Quickplay Sport. Quick-Click Height Adjustable Speed Hurdles for Sports Training. YouTube. Nov. 3, 2016. https://www.youtube.com/watch?v=0kvBpklP0L4.

* cited by examiner

SPORTS TRAINING LADDER AND HURDLE

CROSS-REFERENCE TO RELATED APPLICATIONS

The present Application claims the benefit of U.S. Provisional Patent Application 62/424,379, titled "Sports Training Ladder and Hurdle," filed Nov. 18, 2016, the contents of which are incorporated in this disclosure by reference in their entirety.

BACKGROUND

A sports training ladder, often referred to as an "agility ladder" is commonly used by athletes to improve speed, balance and/or agility. Agility ladders generally have several spaced apart rungs attached to left and right stiles. In use, the agility ladder is placed on the ground, with open foot spaces formed between the rungs and stile. The athlete runs, hops or jumps through the agility ladder, with the athlete's feet landing in the foot spaces. Different training exercises may use different patterns of steps, jumps, or hops.

Some agility ladders have fixed rung distances, meaning that the separation distance between each rung cannot be altered by the user. Other agility ladders have movable rungs which are generally not easy to reposition or lock on the stiles. Some agility ladders can also become easily twisted if not stored properly, causing the user to spend considerable time untangling the ladder before use.

Hurdles are individual raised barriers also used in athletic training. Generally, hurdles are spaced several strides apart, with the athlete running and jumping over each hurdle. Some hurdles have a fixed height of typically 6 inches, 9 inches and 12 inches, which limits use of the hurdles. Other hurdles can be adjusted to variable heights, but are often expensive and/or can become easily damaged if stepped on.

Hurdles and agility ladders are frequently used by teams and coaches and the equipment may be bulky, heavy and difficult to carry and/or store. Obtaining the benefits of both an agility ladder and hurdles requires both sets of equipment to be carried to the training location and then set up.

Therefore, there is a need for an improved agility ladder and hurdles that are conveniently adjustable, user friendly, and easy to transport.

SUMMARY OF TH E INVENTION

A sports training ladder and hurdle of the present invention will address these issues. The present invention provides for adjustable ladders, hurdles and methods of using the same. Optionally, the hurdles can be constructed from the adjustable rungs of the ladder. The present invention also describes advantageous storage and carrying options for storing the ladder and hurdle components.

In particular the present invention provides for a training ladder for use on a surface. The ladder comprises flexible opposed first and second substantially parallel stiles, at least two spaced apart rungs between the stiles and supported by the stiles, each rung having a first and a second end for connection to each of the stiles; and at least one rung having a first clasp in a closed position securing the first end of the rung to the first stile and a second clasp in a closed position securing the second end of the rung to the second stile, where in the closed position the rung with the clasps cannot be moved along the stiles, each clasp having an open position to reposition the rung on the stiles or to remove the rung from the stiles, wherein the ladder is on the surface with the rungs spaced apart for exercise.

In a preferred embodiment each rung has at least one clasp. When each rung has a clasp that affords two positions—open and closed, all of all rungs can be repositioned along the stile and locked in a preferred location. In a most preferred embodiment, each rung has a second clasp. The second clasp like the first clasp has an open and closed position and is located at the end of the rung. By having a clasp at each end of the rung, the rung can be completely removed from the stiles with ease. This is preferable because it allows the user to select the number of rungs for a particular exercise, in addition to altering the number of rungs on the stiles, when the rung is completely removed it can also be used as a crossbar for a hurdle.

In yet another embodiment, the rung optionally comprises a mounting hole there through, where the mounting hole has a diameter. The mounting hole is necessary when the system further comprises a hanger, where the hanger has a diameter. The diameter of the hanger is less than the diameter of the mounting hole on the rung so the hanger can be inserted through the mounting holes for mounting the rungs on the hanger. By hanging the rungs on a hanger, the ladder can be easily stored without becoming tangled. To protect the ladder in transport and storage an optional cover can be used.

In another embodiment the present invention provides for a hurdle. The hurdle having an upright position and a collapsed position, the hurdle comprises a crossbar and a pair of legs pivotally connected to the crossbar. The crossbar has a top surface, a bottom surface, a first crossbar end, and a second crossbar end. Each leg has a proximate end and a distal end where the proximate end is pivotally connected to the crossbar end and the distal end is for placement on an exercising surface. The hurdles are configured such that the distal ends of the legs can be rotated away from the bottom surface of the crossbar in an expanded upright position. When the hurdle is in an upright position it provides height relative to the exercise surface. The height of the crossbar is adjusted by a pivot angle between the crossbar and legs. When the hurdle is in a collapsed position the legs are substantially parallel to the crossbar. Similarly to the rungs, the hurdles can optionally comprise a mounting hole there through. The mounting hole is used to insert a hanger, where the diameter of the hanger is less than that of the mounting hole and can be used for transporting and storing the hurdles.

In another embodiment is a system comprising a ladder and at least one hurdle. The hurdle can be used in close proximity to the ladder or even removably connected to the ladder. In its upright position the crossbar may be over at least part of the ladder, wherein in the collapsed position the legs are pivoted to be substantially parallel to the crossbar. Optionally, the rung of the ladder can function as the crossbar of the hurdle. In this configuration only a pair of legs is required to create a hurdle. If the system comprises the optional legs, then the legs can also have a mounting hole there through to also be stored on the hanger.

In yet another embodiment is a method of using a ladder. The method comprises selecting a ladder having flexible opposed first and second substantially parallel stiles, at least two spaced apart rungs between the stiles and connected to the stiles, each rung having a first and a second end for connection to each of the stiles; and at least one rung having a first clasp in a closed position securing the first end of the rung to the first stile and a second clasp in a closed position securing the second end of the rung to the second stile, where in the closed position the rung with the clasps cannot be moved along the stiles, each clasp having an open position to reposition the rung on the stiles or to remove the rung from the stiles. The user places the ladder on a surface and repositions at least one rung on the stiles by opening the clasps, moving the rung and closing the clasps. The user then performs exercises with the ladder.

In still another embodiment is a method of using a hurdle. The method comprises selecting a hurdle having a crossbar and a pair of legs pivotally connected to the crossbar. The crossbar has a top surface, a bottom surface, a first crossbar end, and a second crossbar end. Each leg has a proximate end and a distal end where the proximate end is pivotally connected to the crossbar end and the distal end is for placement on an exercising surface. In use, the user rotates the distal ends of the legs away from the bottom surface of the crossbar expanding the hurdle in an upright position. When the hurdle is in an upright position it provides height relative to the exercise surface. Optionally, the user can adjust the height of the crossbar by further pivoting the legs away from the bottom surface of the crossbar, thereby increasing the pivot angle between the crossbar and legs. Optionally, the user can adjust the height of the crossbar by decreasing the pivot angle. The user can then perform exercises by jumping over the hurdle. Post use, to collapse the hurdle, the user rotates the distal ends of the legs towards the bottom surface of the hurdle. Once the legs are substantially parallel to the crossbar, the hurdle is in a collapsed position. In the collapsed position the hurdle can be easier to transport and store.

In still another embodiment is a method of using the ladder and system described herein. The method comprises the steps of selecting a ladder having flexible opposed first and second substantially parallel stiles, at least two spaced apart rungs between the stiles and connected to the stiles, each rung having a first and a second end for connection to each of the stiles; and at least one rung having a first clasp in a closed position securing the first end of the rung to the first stile and a second clasp in a closed position securing the second end of the rung to the second stile, where in the closed position the rung with the clasps cannot be moved along the stiles, each clasp having an open position to reposition the rung on the stiles or to remove the rung from the stiles. The user places the ladder on a surface and repositions at least one rung on the stiles by opening the clasps, moving the rung and closing the clasps. Next, the user selects a hurdle that has an upright position and a collapsed position, the hurdle comprises a crossbar and a pair of legs pivotally connected to the crossbar, wherein in the collapsed position the legs are pivoted to be substantially parallel to the crossbar. The hurdle is positioned in in its upright position with the crossbar over the at least part of the ladder and the user performing exercises with the ladder, and jumping over the hurdle. It should be noted that the hurdles do not have to be used in connection with the ladder when exercises are being performed. The hurdles can also be used separately from the ladder.

In another embodiment is a method of using a ladder system. The method comprises the steps of selecting a ladder having flexible opposed first and second substantially parallel stiles, at least two spaced apart rungs between the stiles and connected to the stiles, each rung having a first and a second end for connection to each of the stiles; and at least one rung having a first clasp in a closed position securing the first end of the rung to the first stile and a second clasp in a closed position securing the second end of the rung to the second stile, where in the closed position the rung with the clasps cannot be moved along the stiles, each clasp having an open position to reposition the rung on the stiles or to remove the rung from the stiles. The user places the ladder on a surface and removes the rung with the clasps from the stiles by opening each clasp. The user then secures a leg to each clasp of the removed rung, each leg has a proximate end and a distal end where the proximate end of the leg is pivotally connected to the clasp and the distal end is placed on the surface. The user then performs exercises with the ladder and jumps over the hurdle.

In another embodiment the present invention provides for a kit. The kit comprises a ladder described above and at least one hurdle having an upright position and a collapsed position, the hurdle comprising a crossbar and a pair of legs pivotally connected to the crossbar, the hurdle in its upright position with the crossbar over the at least part of the ladder, wherein in the collapsed position the legs are pivoted to be substantially parallel to the crossbar. Optionally, the ladder and hurdle can be packaged together.

In still another embodiment the present invention provides for a kit comprising a ladder described above and a pair of legs, each leg having a proximate end and a distal end where the proximate ends of the legs are pivotally connected to the rung with the clasps creating a hurdle, the hurdle in an upright position when the distal ends are placed on the surface and when the distal ends are pivoted to be substantially parallel to the rung the hurdle is in a collapsed position. The ladder and legs can optionally be packaged together.

DRAWINGS

The following drawings form part of the present specification and are included to further demonstrate certain aspects of the present invention. The invention may be better understood by reference to one or more of these drawings in combination with the detailed description of specific embodiments presented herein, where:

DETAILED DESCRIPTION

The present invention is directed toward training ladders, hurdles and methods for using the same. In the following description, numerous specific details are set forth to provide a more thorough description of embodiments of the invention. It will be apparent, however, to one skilled in the art, that the embodiments of the present invention may be practiced without these specific details. In other instances, well known features have not been described in detail so as not to obscure the invention.

It is noted that, as used in this specification and the appended claims, the singular forms "a," "an," and "the," include plural referents unless expressly and unequivocally limited to one referent. As used herein, the term "include and its grammatical variants are intended to be non-limiting, Such that recitation of items in a list is not to the exclusion of other like items that can be substituted or other items that can be added to the listed items.

As used in this disclosure, except where the context requires otherwise, the term "comprise' and variations of the term, such as "comprising," "comprises," and "comprised" are not intended to exclude other additives, components, integers or steps. Thus, throughout this specification, unless the context requires otherwise, the words "comprise", "comprising" and the like, are to be construed in an inclusive sense as opposed to an exclusive sense, that is to say, in the sense of "including, but not limited to."

As used in this disclosure, except where the context requires otherwise, the method steps disclosed are not intended to be limiting nor are they intended to indicate that each step is essential to the method or that each step must occur in the order disclosed.

Figure 1:
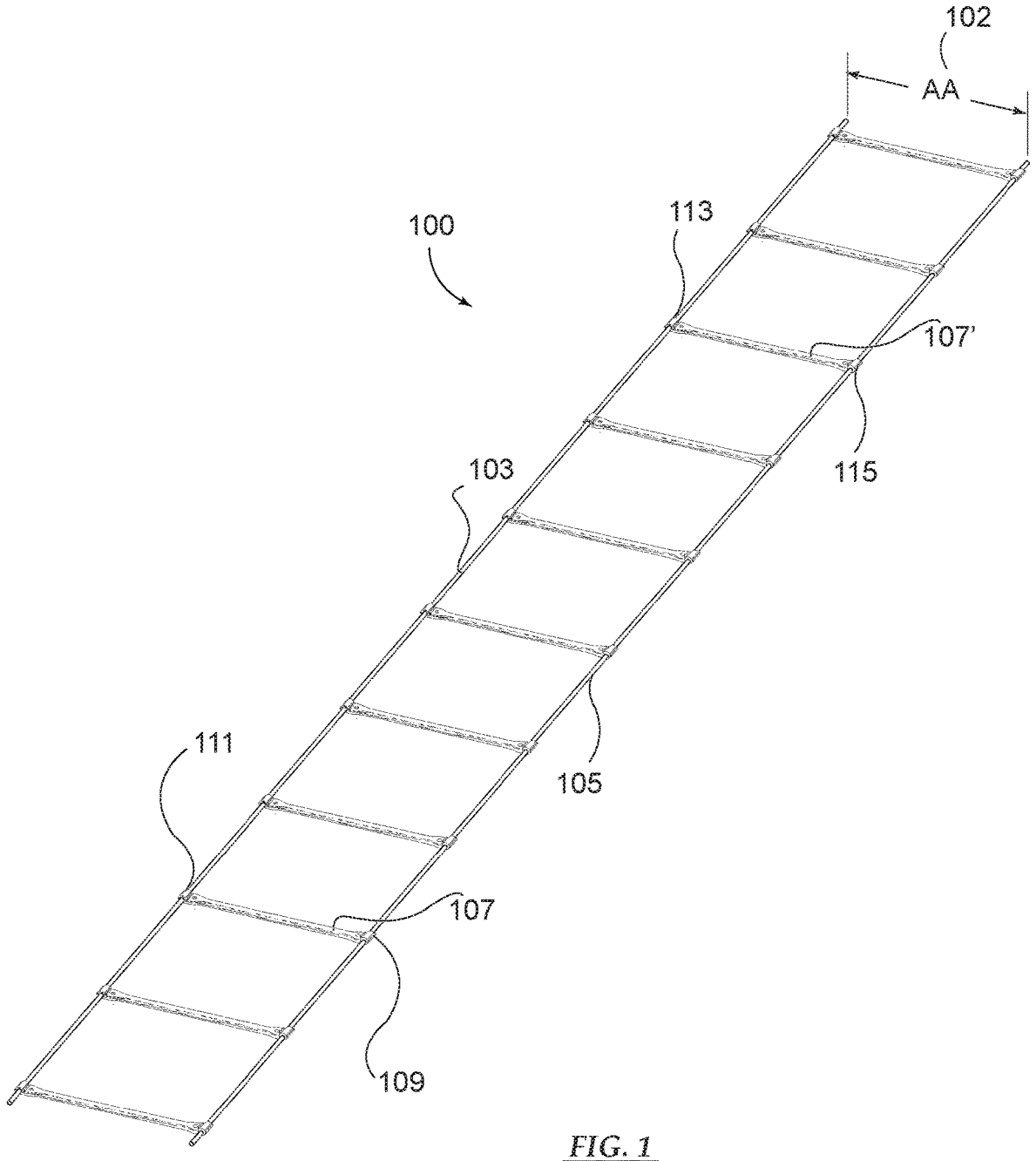
FIG. 1 illustrates one embodiment of the ladder on a surface in an expanded position.

Turning now in detail to the drawings, as shown in FIG. 1 is a training ladder 100 for use on a surface 101, such as the ground. The ladder 100 includes flexible opposed first and second substantially parallel stiles 103, 105 at least two spaced apart rungs 107, 107' between the stiles 103, 105 and connected to the stiles 103, 105 each rung 107, 107' having a first 109 and a second end 111 for connection to each of the stiles 103, 105 and at least one rung 107' having a first clasp 113 in a closed position 117 securing the first end 109 of the rung 107' to the first stile 103 and a second clasp 115 in a closed position 117 securing the second end 111 of the rung 107' to the second stile 105, where in the closed position 117 the rung 107' with the clasps 113, 115 cannot be moved along the stiles 103,105. Each clasp 113, 115 has an open position 119 to reposition the rung 107' on the stiles 103,105 or to remove the rung 107' from the stiles 103, 105. The rungs 107, 107' spaced apart for exercise. The open and closed positions 117, 119 of the clasps 113, 115 are shown in FIGS. 2 and 3.

Preferably the stiles 103, 105 of the ladder 100 are made of a flexible material meaning the stiles 103, 105 can be folded up, collapsed, rolled-up, or bent backwards so the ladder 100 can be conveniently stored in a compact arrangement. Examples of flexible materials include, but are not limited to string, rope, cord, fabric, elastic, or nylon webbing. Flat webbing is not preferred because it can become twisted if the ladder 100 is not stored correctly. Therefore, in a preferred embodiment, the stiles 103, 105 are composed of cord or rope providing a substantially circular cross section 121. The length of the stiles 103,105 will depend on the number of rungs 107, 107' in that fewer rungs 107, 107' will require less length and conversely more rungs 107, 107' requires greater stile 103, 105 length. In a preferred embodiment, the length of each stile 103, 105 is approximately 10 to 20 feet and in a most preferred embodiment the length of each stile 103, 105 is between 12 and 17 feet. One continuous length of material can be used to configure the two parallel opposed stiles 103, 105 however two pieces of material can also be used so long as each stile 103, 105 is parallel to each other to accommodate the rungs 107, 107' in between.

Unlike the stiles 103, 105 the rungs 107, 107' are preferably constructed from a more rigid material such as plastic. Plastics such as polypropylene may be used to provide lightweight rungs 107, 107' with sufficient strength and stiffness to endure repeated stepping on. However, the rungs 107, 107' can also be formed using other suitable materials such as metal, rubber or a combination of different materials. Each rung 107, 107' is generally a flat, planar elongated beam with two ends a first rung end 109 and a second rung end 111. When the rungs 107, 107' are flat, they can be stacked in a compact arrangement for convenient storage. Preferably, the rungs 107, 107' have a rectangular cross section, although square, round and other shapes can be used. Shapes having rounded edges, such as a rectangle with curved shorter sides, instead of flat sides and sharp corners can also be used. In a preferred embodiment, the length 102 AA of the ladder rungs 107, 107' can range from about 10 inches to 20 inches and in a most preferred embodiment the length of the rungs 107, 107' is between 15 to 17 inches.

The ladder shown in FIG. 1 has rungs 107, 107' equally spaced apart about 16 inch centers. However, the rungs 107, 107*a* may optionally have different spacing, such as progressively closer spacing, or random spacing. Preferably the ladder 100 can be used with 2 to 11 rungs 107, however more than 12 rungs 107 can also be used.

Figure 2A:
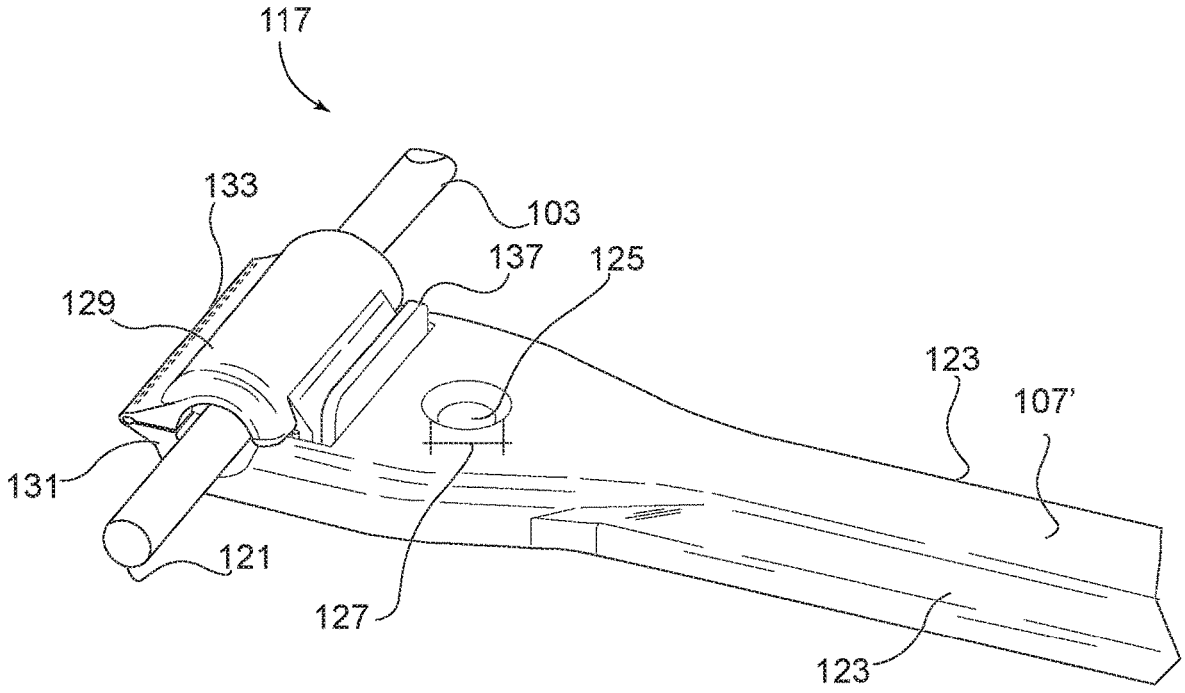
FIG. 2A illustrates an exploded view of the stile rung connection with the clasp in a closed position.
Figure 2B:
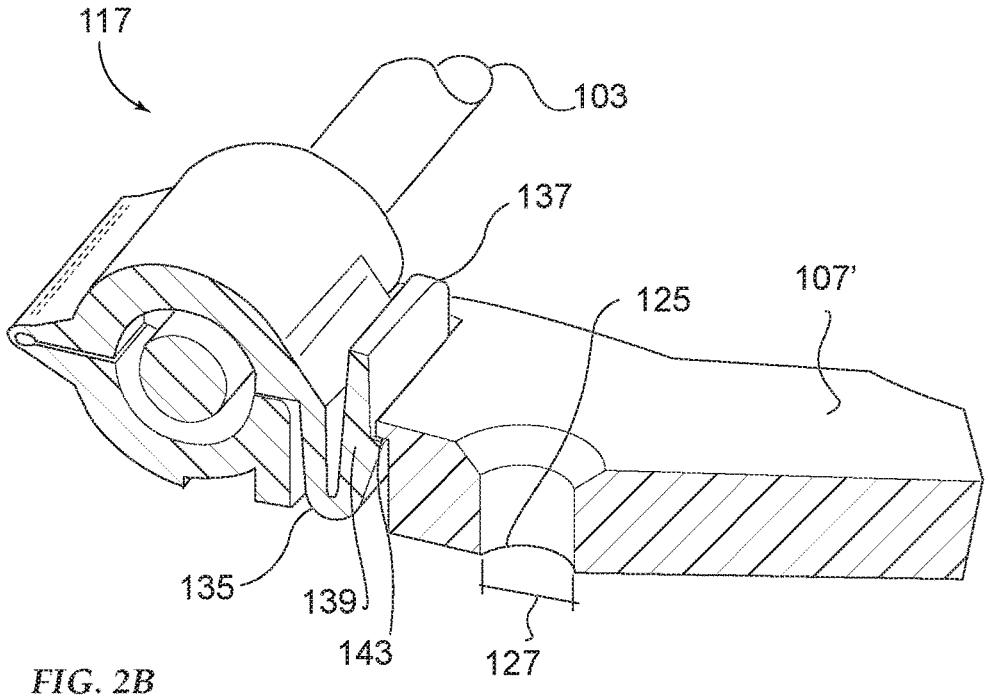
FIG. 2B illustrates a cross section of the stile rung connection similar to that of FIG. 2A with the clasp in a closed position.

With reference to FIGS. 2A and 2B, generally, the rungs 107, 107' are straight but can optionally be curved, or have curved sections. Preferably the rungs 107, 107' can have beveled edges 123 which prevent the user's foot from catching the edges of the rung 107, 107'. Optionally, the each rung 107, 107' may include a mounting hole 125 there through. The term "mounting hole" refers to an opening in the rung 107, 107' whereby a stringing material or rod can be passed through. The mounting hole 125 has a mounting hole diameter 127 and can assist in the storage of the ladder 100 and other components.

At least one rung 107' on the ladder 100 includes a first clasp 113 located at the first end 111 of the rung 107'. The clasp 113 removably attaches the rung 107' to the stile 103. Thus, depending on the desired use of the ladder 100, the rung 107' can be fastened to different locations along the stiles 103, 105. Each first clasp 113 has a closed position 117 and an open position 119. In the closed position 117 the clasp 111 grips the stile 103 and prevents the rung 107' from moving along the stile material. In the open position 119 the clasp 111 is disconnected from the stile 103. In this configuration where the rung 107' only has a first clasp 113 at one rung end 111, the other rung end 109 can be connected to the stile 105 by any means so long as the rung 107' remains movable on the stile 103. In a preferred embodiment, the second rung end 109 has a second clasp 115. This configuration not only allows for the rung 107' to be moved and repositioned along the stiles 103,105 but also allows for the rung 107' to be completely removed from the stiles 103,105.

FIGS. 2A and 2B illustrate a clasp 113, 115 used in embodiments in the ladder 100. For ease of illustration the first clasp 113 is shown in the closed position 117. The clasp 113 has a top half 129 and a bottom half 131, connected via a hinge 133. In this embodiment, the hinge 133 is a living hinge, formed via a thin section of flexible plastic material. Alternatively, the hinge 133 may be a mechanical hinge, whereby the top half 129 and the bottom half 131 are separate parts, pivotally attached with a pin extending through them. Separate conventional hinges may also be attached to the top half 129 and bottom half 131 via fasteners to provide pivotal attachments. The living hinge 133 advantageously allows for the rung 107' and clasp 113 to be formed or molded as a single part, thereby reducing the cost of manufacture.

FIG. 2B shows a cross section view of the clasp 113 in the closed position 117. The clasp 113 may include a spring latch 135, which functions to keep the clasp 113 in the closed position. The spring latch 135 comprises a tab 137 and a latch ledge 139. In the closed position 117, the spring latch 135 may engage with a slot 141 and a slot ledge 143. When the tab 137 is pressed by the user, the latch ledge 139 moves past the slot ledge 143, allowing the spring latch 135 to be released from the slot 141, thus the clasp 113 can be placed in the open position 119. The spring latch 135 may have a curved or shape, allowing the spring latch 135 to bend when pressed and then return to shape.

Figure 3A:
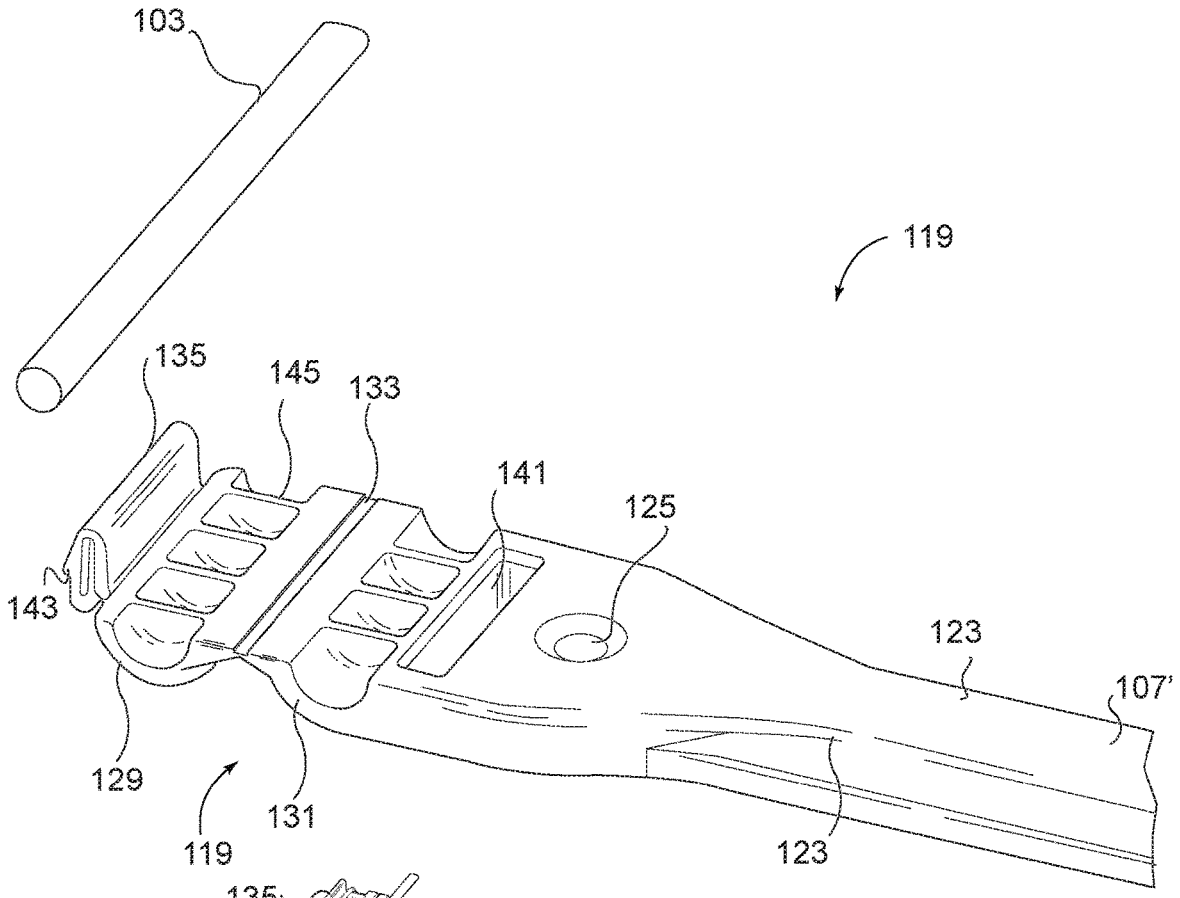
FIG. 3A illustrates an enlarged view of the stile rung connection with the clasp in an open position.

FIG. 3A illustrates a close up of the clasp 113 in the open position 119, whereby the top half 129 has pivoted about the hinge 133. The top half 129 and bottom half 131, have at least one rib 145 and preferably a plurality of ribs 145. When the clasp 113 is in the closed position 117, the ribs 145 grip the stiles 103, 105, thus preventing the rung 107' from moving along the stiles 103,105. Note that a clasp 113, 115 having the configuration as shown and described-specifically having a closed 117 and open position 119, advantageously allows a user to reposition and secure the rung 107' on the stiles 103, 105 using a single part and without the assistance of a tool.

Figure 3B:
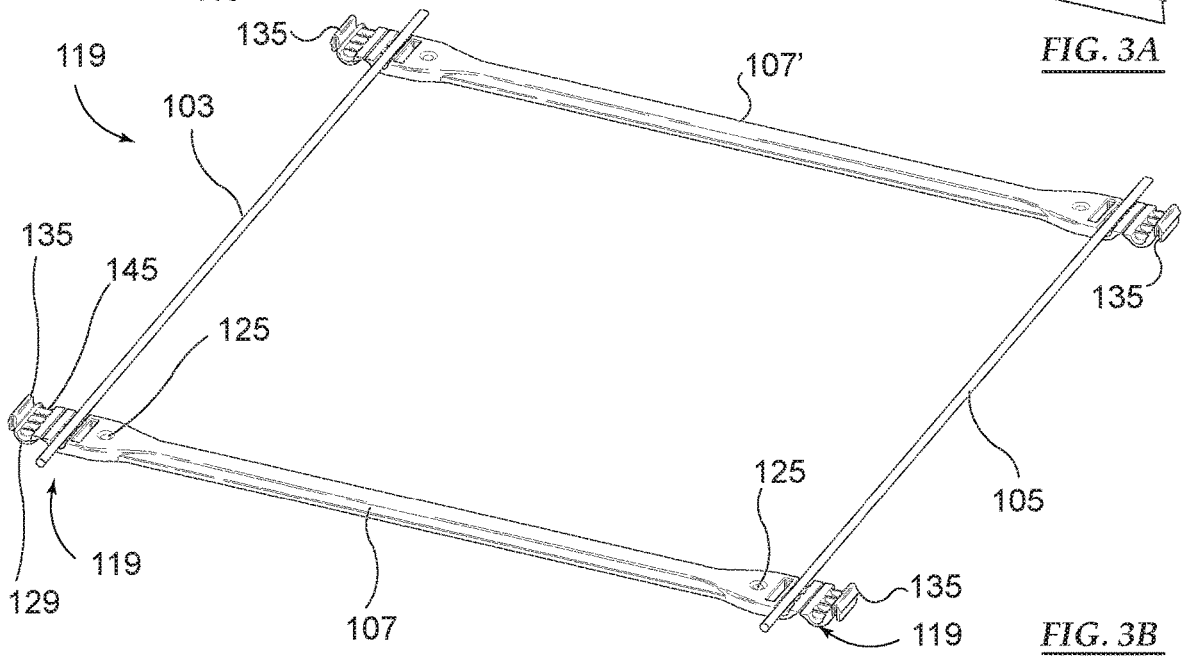
FIG. 3B illustrates an enlarged view of the stile rung connection similar to FIG. 3A.

FIG. 3B shows a perspective view of the ladder 100 where each rung 107' illustrated has a first and second clasp 113, 115 located at each rung end 109,111. The clasps 113, 115 on the rungs 107' are shown the open position 119. As discussed above, for each rung end 109, 111 to be removed from the stiles 103, 105 the clasps 113, 115 at each rung end 109, 111 are in the open position 119.

Figure 4:
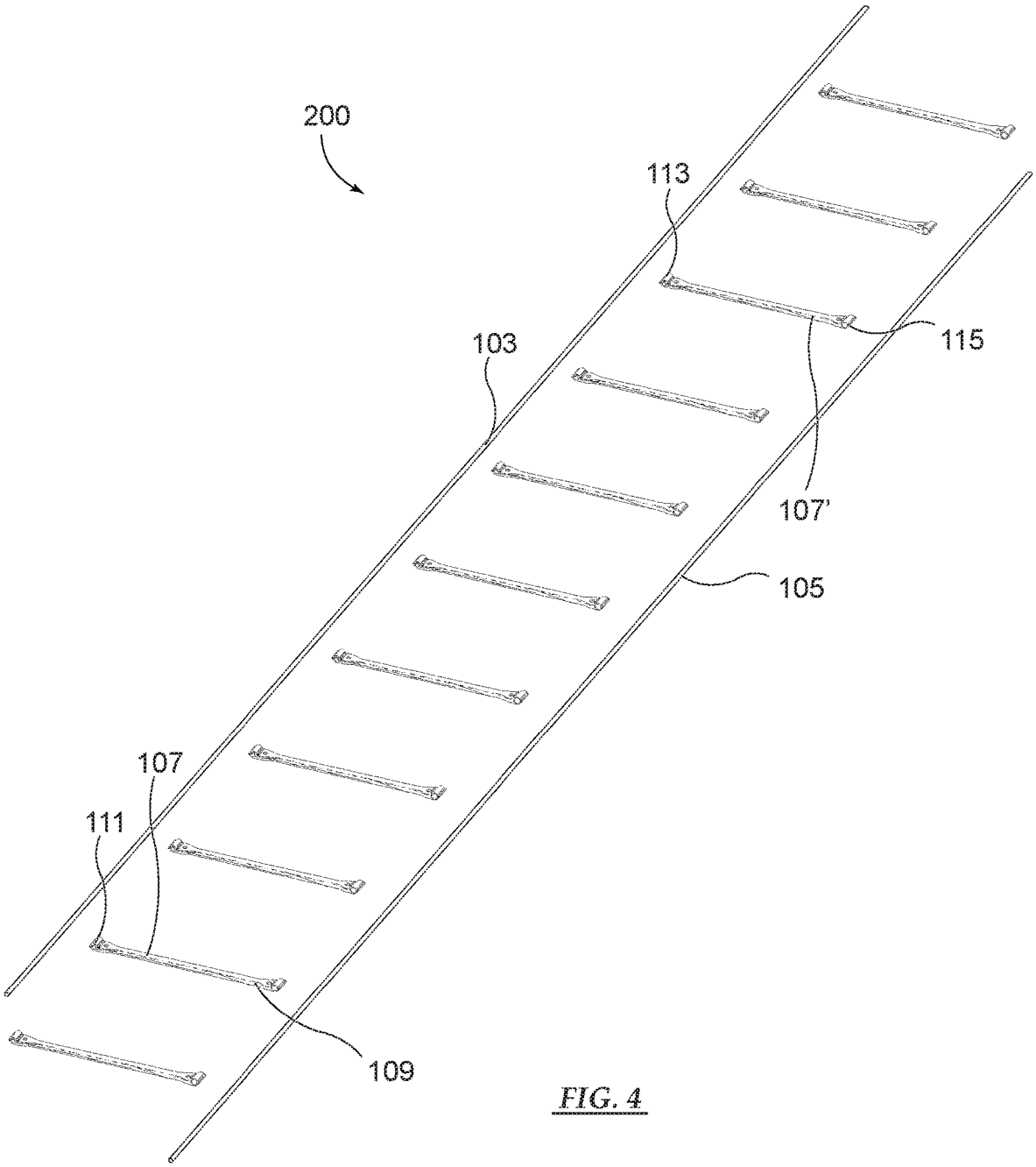
FIG. 4 illustrates a perspective view of a ladder with all of the rungs removed from the stiles.

FIG. 4 shows an exploded perspective view of another embodiment of the ladder 100 where each rung 107' is removed from the stiles 103, 105.

Figure 5A:
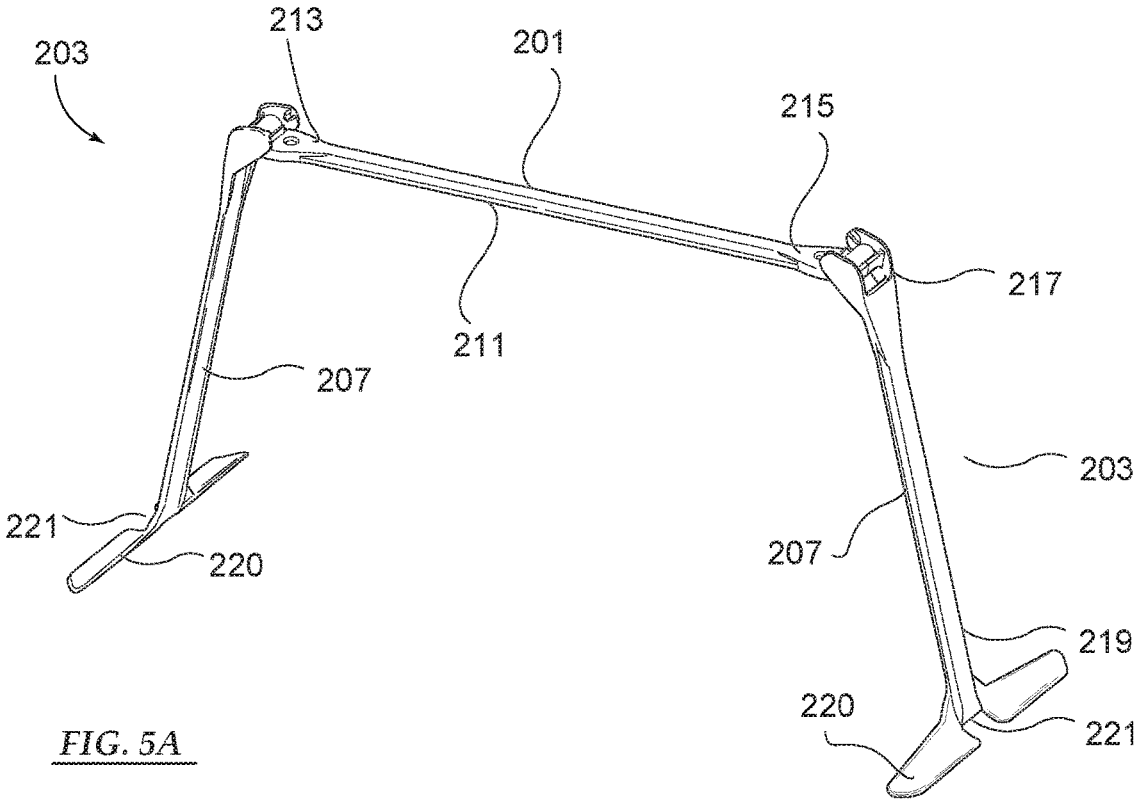
FIG. 5A illustrates a hurdle in an upright position.

In another embodiment the present invention provide for a hurdle 200 as shown in FIG. 5. The hurdle 200 has an upright position 203 and a collapsed position 205, the hurdle has a crossbar 201 and a pair of legs 207 pivotally connected to the crossbar 205. The cross bar has a top surface 209, a bottom surface 211, a first crossbar end 213, a second crossbar end 215. Each leg 207 has a proximate end 217 and a distal end 219 where the proximate end 217 is pivotally connected to each crossbar end 213, 215. The distal ends 219 are for placement on the surface 101. The legs 207 being pivotally attached to the crossbar 201 allows for the legs 207 to rotate relative to the crossbar 201.

The distal end 219 may have a base 220 to support and sturdy the hurdle 200 on the exercising surface. The base 200 can have a curved cross section, which may provide minimal friction in relation to the exercising surface 101. Therefore, if the hurdle 200 is accidentally stepped on with force the curved profile of the base 220 allows the leg 207 to slide outwards, until the leg 207 is horizontal with the ground, reducing the likelihood of breakage of the hurdle 200 or injury to the athlete.

Plastic materials, such as polypropylene may be used to provide lightweight hurdles 200 with sufficient strength and stiffness. However, it is contemplated that the hurdles 200 may be formed using other suitable materials such as metal or rubber or combinations of different materials. Preferably, the length of the leg 207 is between 10 inches to 17 inches, and most preferably 12 to 14 inches.

Figure 5B:
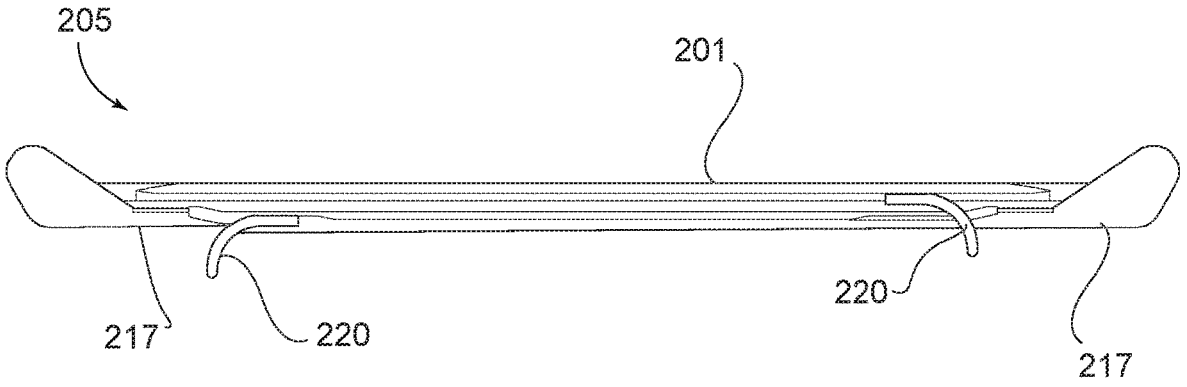
FIG. 5B illustrates a hurdle in a collapsed position.
Figure 5C:
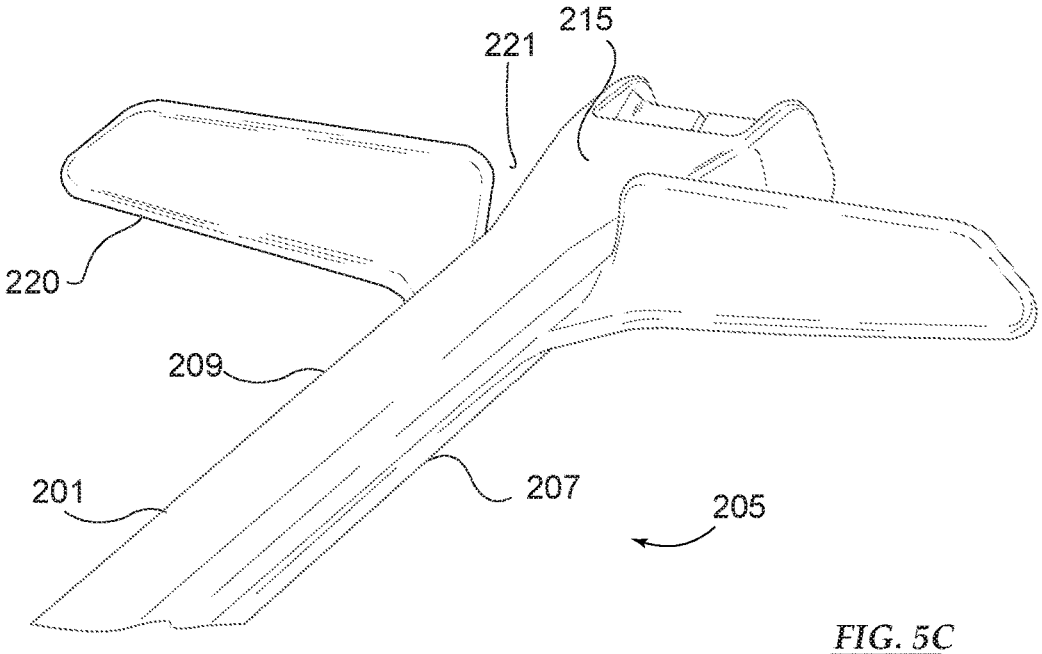
FIG. 5C illustrates an exploded view of the hurdle in a collapsed position.

When the hurdle 200 is in a collapsed position 205 as shown in FIG. 5B, the legs 207 are pivoted towards the bottom surface 211 of the crossbar 201 to be substantially parallel to the crossbar 201. The distal ends 219 of the legs 207 may include a cutout 221, which is sufficiently wide enough to allow the opposing leg 207 to fit inside the cutout 221 when the hurdle 200 is collapsed, as shown in FIG. 5C. When the hurdle legs 207 are folded flat against the crossbar 205 it creates an efficient package size, as shown in FIG. 5B. The cutout also allows for the hurdle to optionally connect to the rung ends 109, 111 of the ladder 100.

Figure 6:
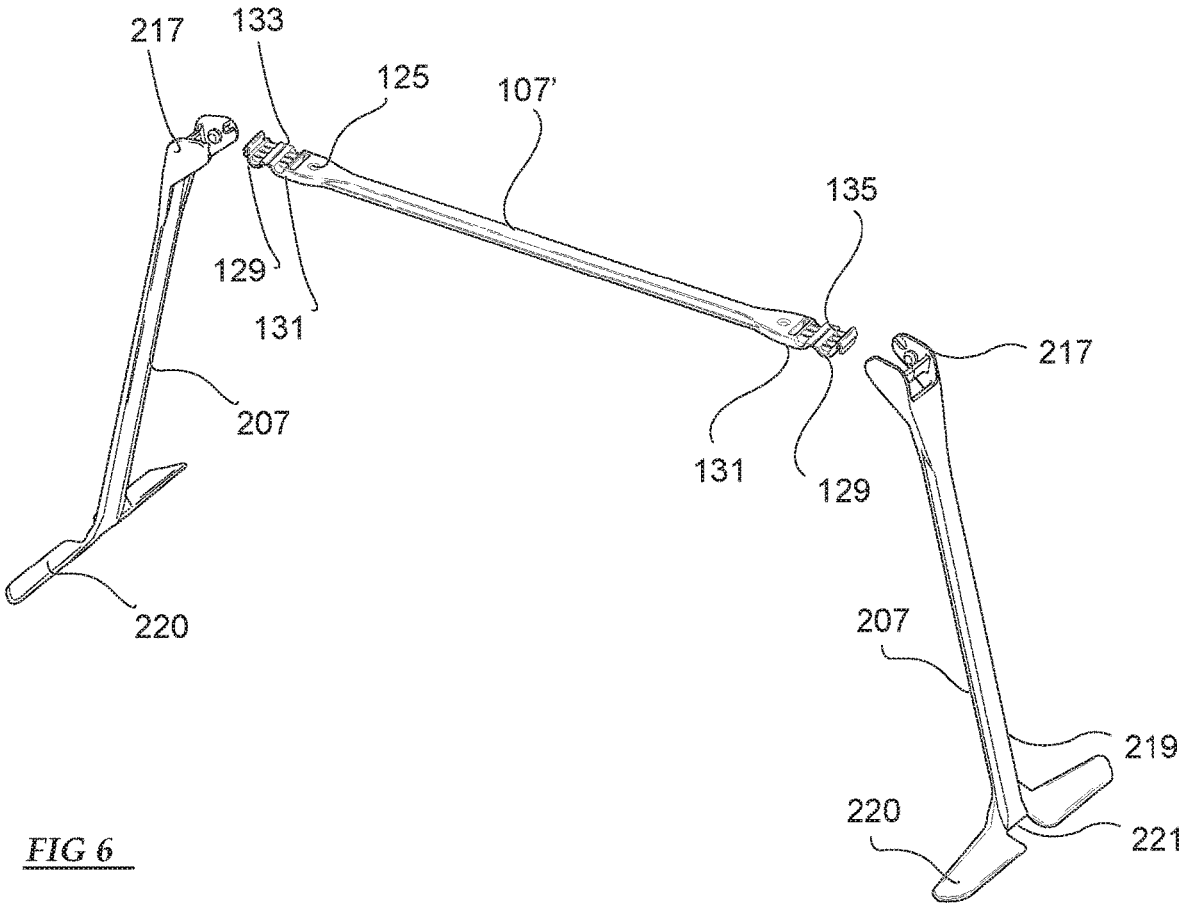
FIG. 6 illustrates another embodiment where the rung of the ladder is the crossbar of the hurdle.

Another utility of the present invention is illustrated in FIG. 6. The rung 107' of the ladder 100 can advantageously be used as the crossbar 201 of the hurdle 200. When the clasps 113, 115 are in the open position 119, the proximate end 217 of each leg 207 can be attached to each clasp 113, 115.

Figure 7:
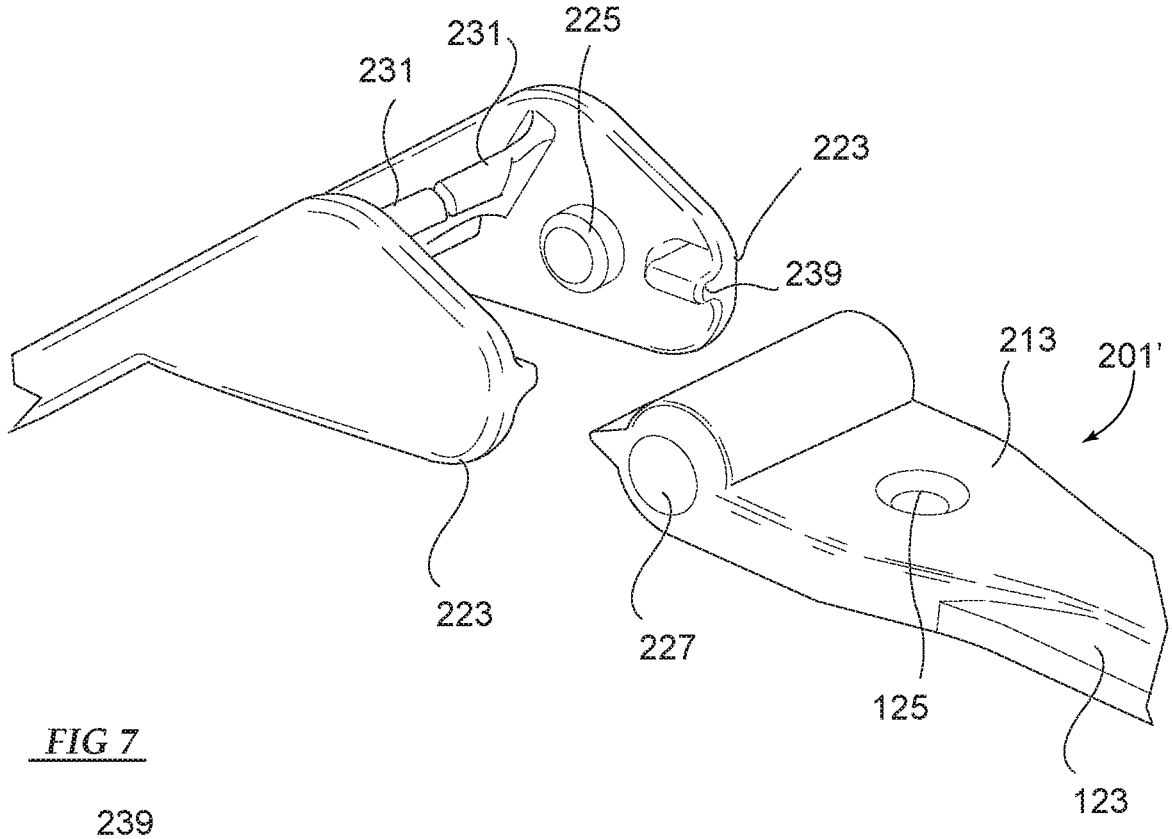
FIG. 7 illustrates an exploded view of an embodiment of the connection between the legs and crossbar.
Figure 7A:
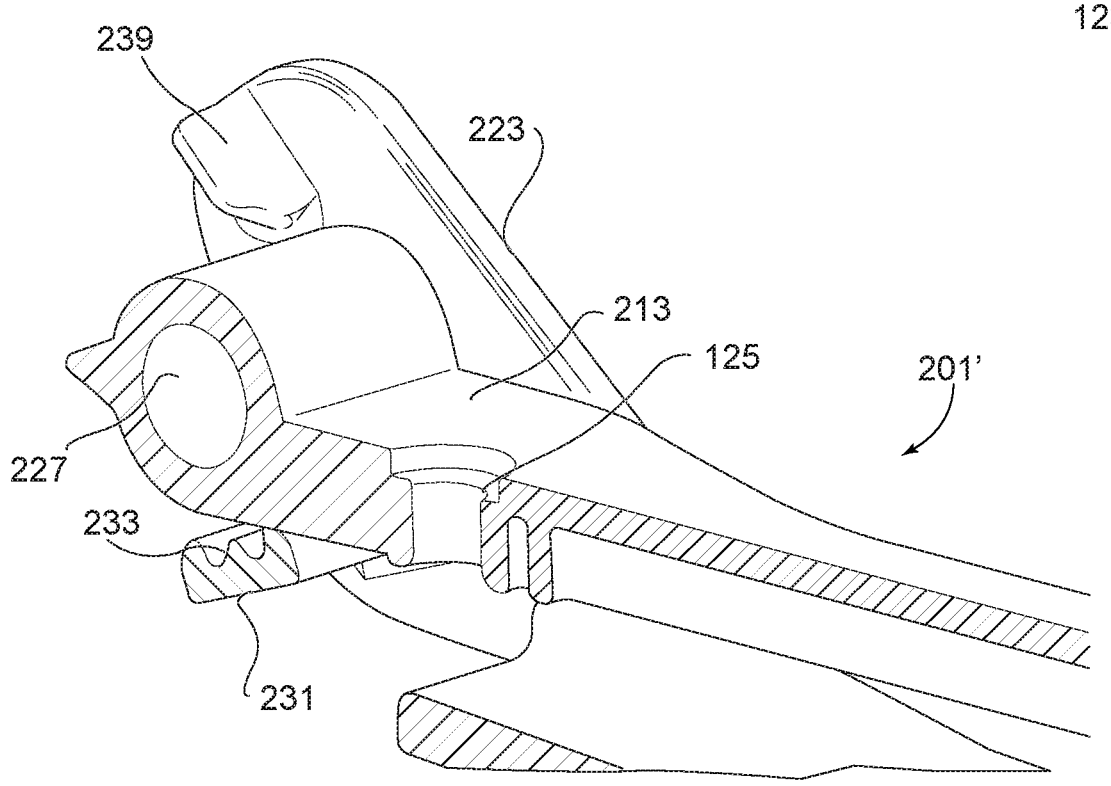
FIG. 7A illustrates a cross section of the connection shown in FIG. 7.

FIG. 7 illustrates an exploded view of one example of a connection between the leg 207 and crossbar 201' components. The proximate end 217 of the leg 207 includes a first and second shoulder 223, and a first and second pivot post 225. The second pivot post 225 is a mirror image of the first pivot post 225. The pivot posts 225 are sized appropriately to fit into a hollow end 227 of the crossbar 201'. Unlike the rung 107', the crossbar 201' utilized in FIG. 7 does not have a clasp 113, 115 having an open and closed position 119, 117 but rather a single molded crossbar end 213', 215' having an opening to receive the pivot posts 225. In this configuration the shoulders 223 are flexible enough to stretch to accommodate insertion of the pivot posts 225. FIG. 7A illustrates a cross sectional view of the connection shown in FIG. 7. Alternatively, an opposite configuration is also possible. For example, the pivot posts 225 could extend from the crossbar 201 and a hollow end 227 could be positioned on the proximate end 217 of the leg 207. Those skilled in the art will appreciate that there are numerous possibilities to pivotally attach the legs 207 to the crossbar 201 and the examples provided are not intended to be limiting.

Figure 8:
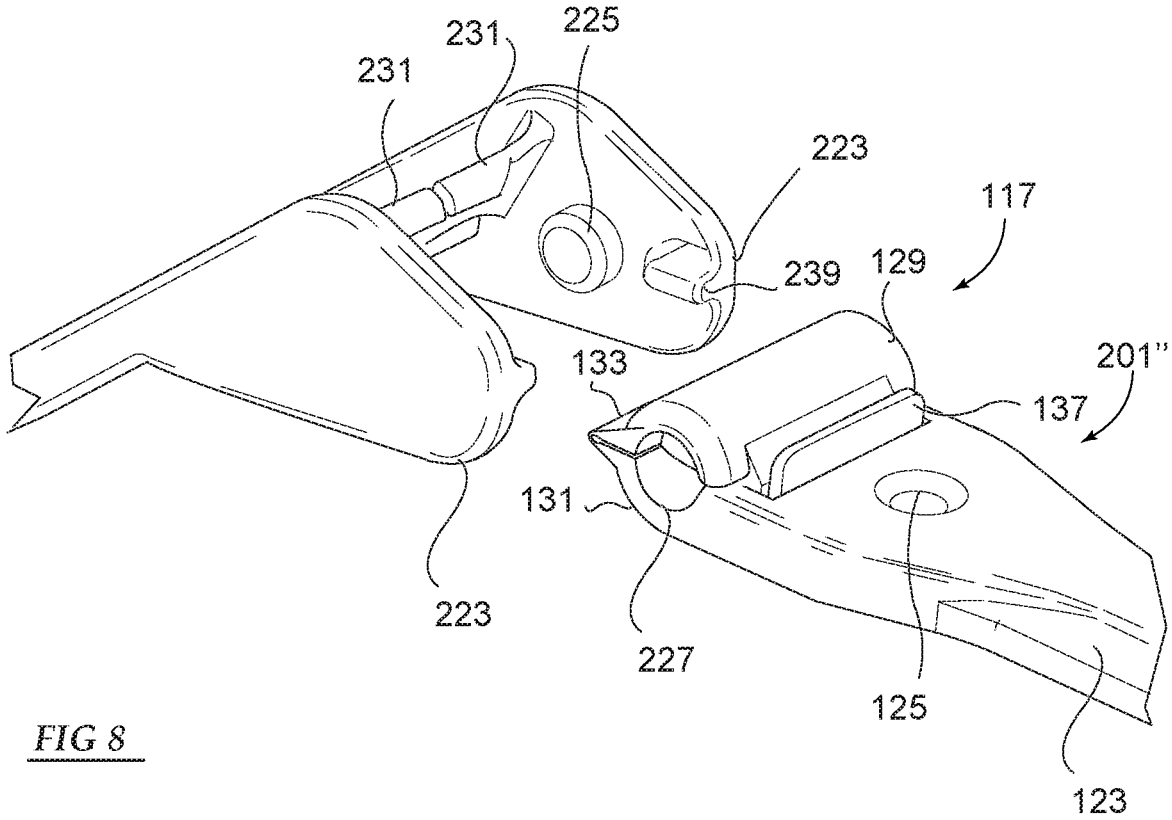
FIG. 8 illustrates an exploded view of an embodiment of the connection between the legs and crossbar.

Now referring to FIG. 8 which illustrates when the rung 107' having clasps 113, 115 is used to create a hurdle 201". In this example, the proximate ends 217 of the legs 207 have the same configuration as shown in FIGS. 7 and 7A specifically, a first and second shoulder 223, and a first and second pivot post 225. The second pivot post 225 being a mirror image of the first pivot post 225. Preferably, the shoulders are flexible enough to stretch to receive the pivot posts 225. If the shoulders cannot be flexed, in this configuration the claps 113, 115 can be placed in the open position 119 to receive the pivot posts 225.

Once the legs 207 are connected as shown in FIG. 7 or FIG. 8, they can pivot about the ends 213, 215 of the crossbar 201 and the hurdle 200 can be alternated between an upright 203 and collapsed 205 positions. The legs 207 can also comprise one or more snap members 231, preferably located on the proximate end 217 which snap into a receiving feature on the crossbar. The snap member 231 aids in the rotation of the legs 207 about the ends 109, 111 of the crossbar 201. The pivot angle 229 between the crossbar 201 and each leg 207 provides for height 242 adjustment of the crossbar 201 relative to the exercising surface 101.

Figure 8A:
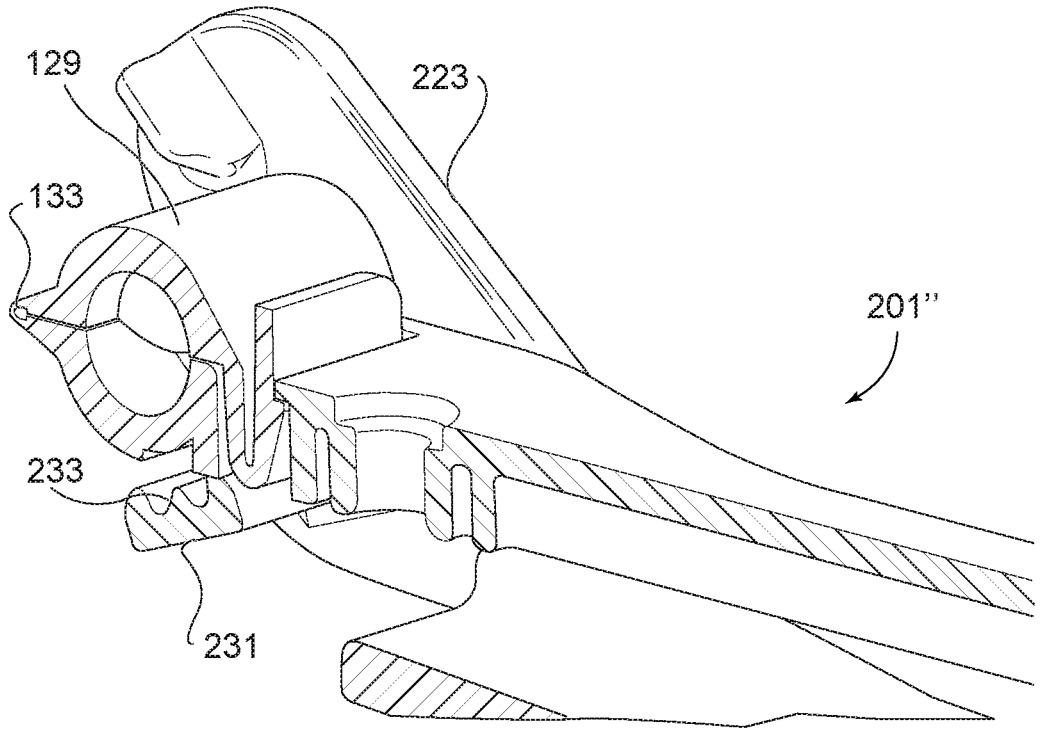
FIG. 8A illustrates a cross section of the connection between the legs and the crossbar shown in FIG. 8.
Figure 8B:
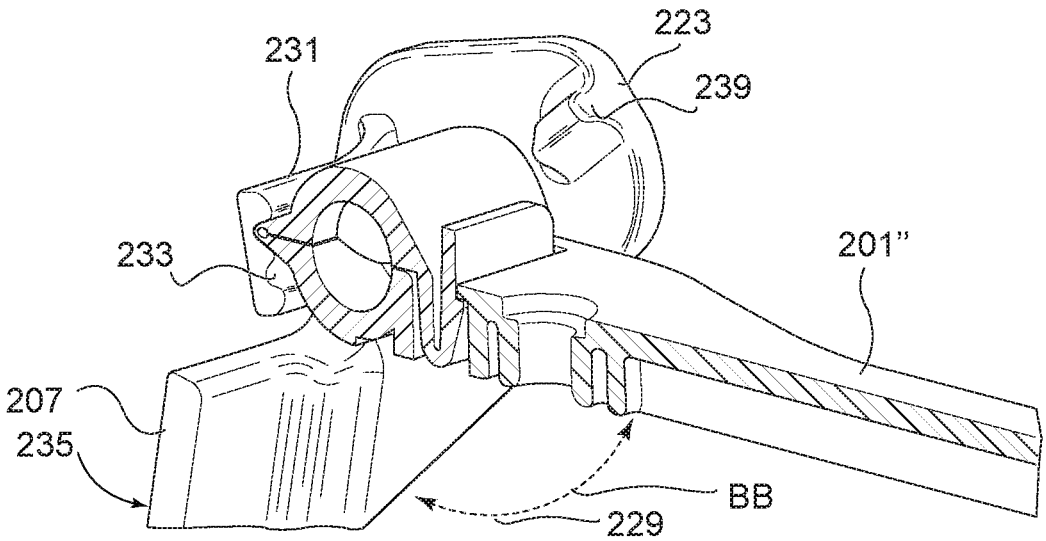
FIG. 8B illustrates the connection between the crossbar and the legs similar to FIG. 8A.
Figure 8C:
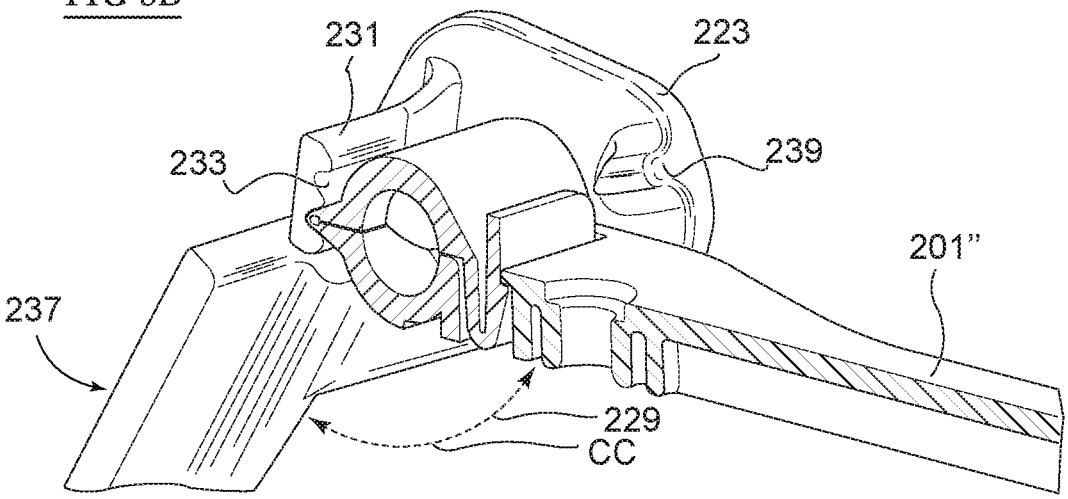
FIG. 8C illustrates the connection between the crossbar and the legs similar to FIGS. 8A and 8B.
Figure 8D:
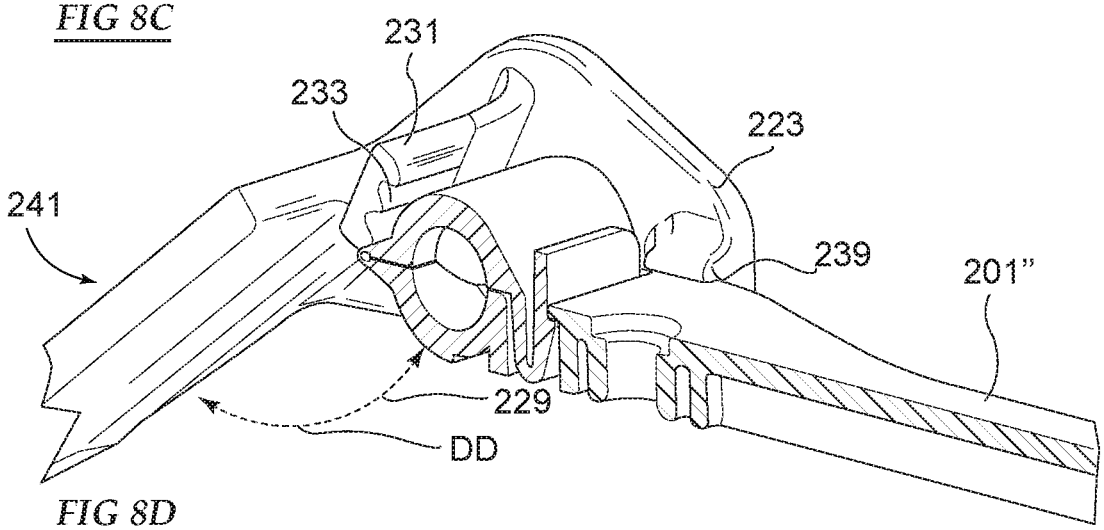
FIG. 8D illustrates the connection between the crossbar and the legs similar to FIG. 8A-8C.

For ease of illustration only the crossbar 201" leg 207 connection shown in FIG. 8 is shown in FIGS. 8A-8D. FIGS. 8A-8D show cross section views of the crossbar 201" and leg 207 connection when the leg is located in different positions. A snap member 231 may extend perpendicular to the surface of one or more of the shoulders 223. The snap member 231 may have a plurality of grooves 233, of an equivalent size and shape to that of the hinge 133. FIG. 8A shows a leg 207 in the collapsed position 205, which is also shown in FIG. 5B. As shown in FIG. 8B the leg 207 has pivoted about the end 213 of the crossbar 201". As the snap member 231 encounters the hinge 133, the flexible nature of the material allows the snap member 231 to bend out of the way of the hinge 133 and then move back into position, aligning with one of the grooves 233, thereby locking the leg 207 in a first hurdle position 235, at a pivot angle 229 BB in relation to the crossbar 201". As shown in FIG. 8C, the user may apply reasonable force to continue pivoting the leg 207, causing the snap member 231 to bend out of the way for a second time and then move back into position, locating in a second groove 233, thereby locking the leg 207 in a second hurdle position 237, at a pivot angle 229 CC in relation to the rung 201. In the preferred embodiment, there may be two grooves 233, however it is contemplated that there may be fewer grooves 233, resulting in fewer hurdle 200 positions. Likewise, additional angle settings can be achieved by adding further grooves 233 to the snap member 231. As shown in FIG. 8D, the user may apply reasonable force to continue pivoting the leg 207, causing the snap member 231 to bend out of the way and move back into position for a third time, where no grooves 233 are in contact with the hinge 133. As the leg 207 continues to pivot a stop block 239 may be provided to prevent the leg 207 from pivoting further, thereby locking the leg 207 in a third hurdle position 241, at a pivot angle 229 DD in relation to the crossbar 201. In the preferred embodiment, a combination of snap members 231 and stop blocks 239 have been used, however it is contemplated that only snap members or only stop blocks may be used to achieve the same effect. Alternatively, other methods of locking the legs 207 at various angles may be used including but not limited to a removable cotter pin or a spring button.

Figure 9:
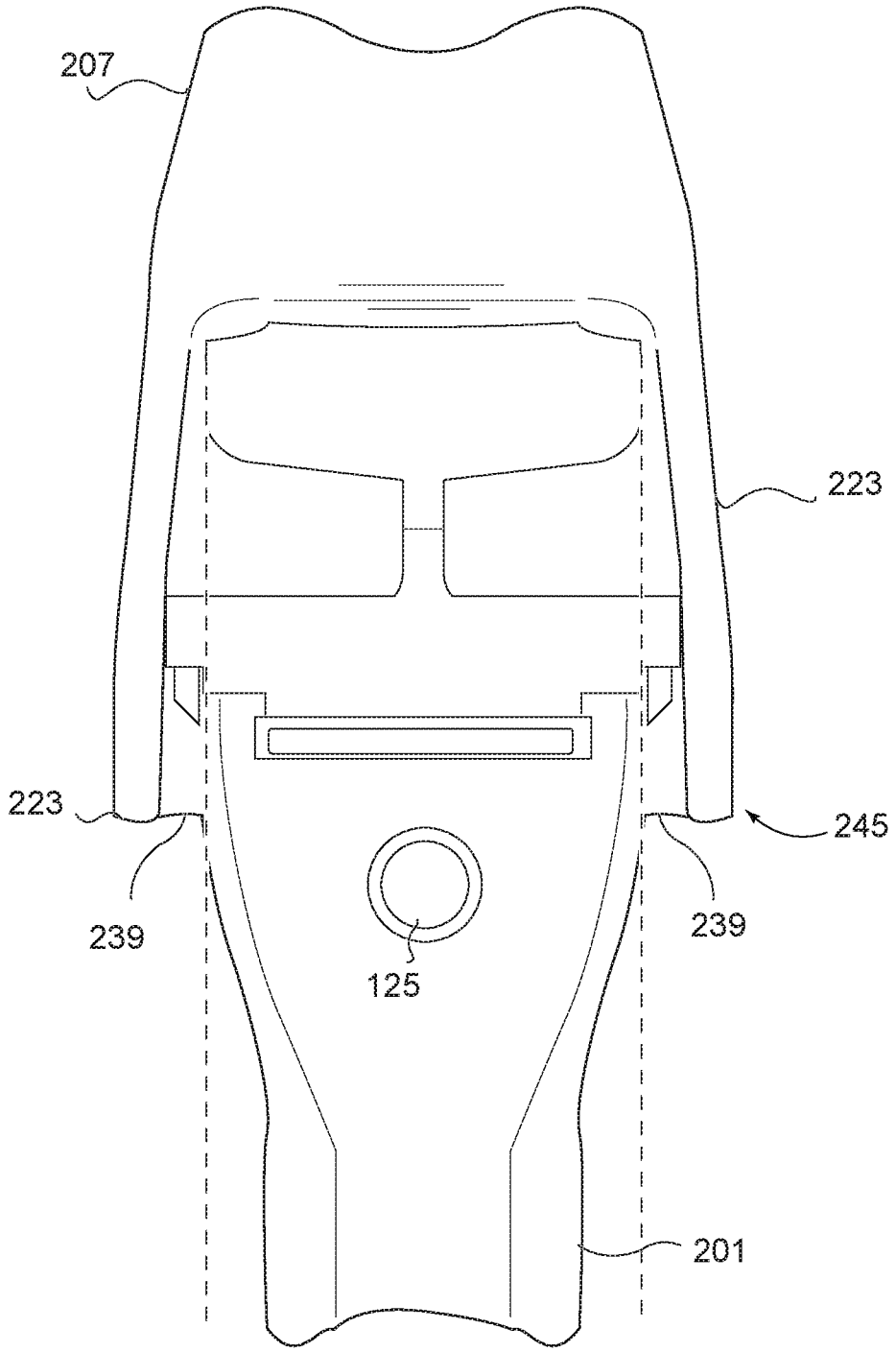
FIG. 9 illustrates a top plan view of the connection between the crossbar and leg.

FIG. 9 shows a top view of a safety feature 245 of the hurdle 200. If substantial force is applied to the leg 207, for example by a user accidentally stepping on the hurdle 200 during use, the shoulders 223 may be sufficiently flexible enough to bend outward away from the crossbar 201, allowing the stop block 239 to continue to move past the edges of crossbar 201. This feature prevents breakage of the legs 207 or the crossbar 201. Using reasonable force, the user can then rotate the leg 207 in the opposite direction returning the leg 207 to the third hurdle position 241.

Figure 10A:
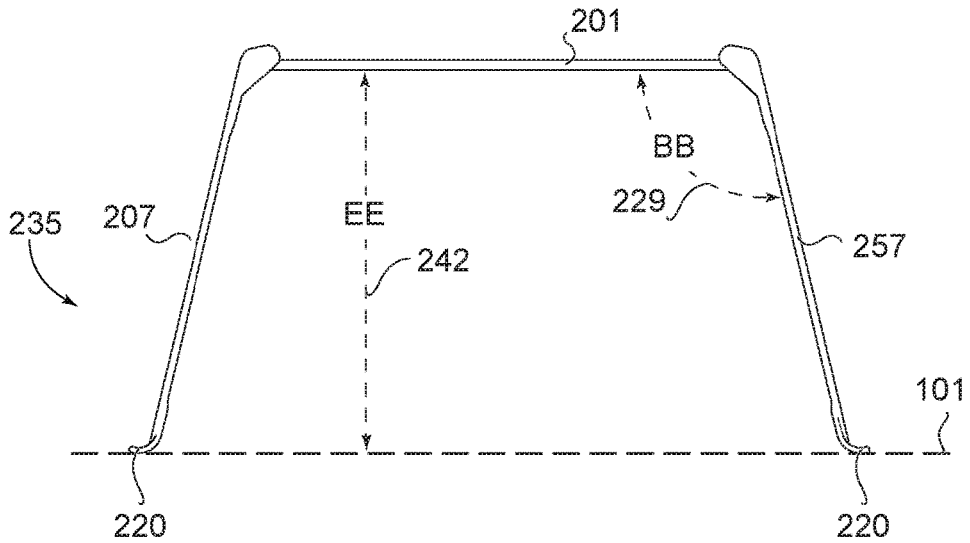
FIG. 10A-10C illustrate the various heights of the hurdle.
Figure 10B:
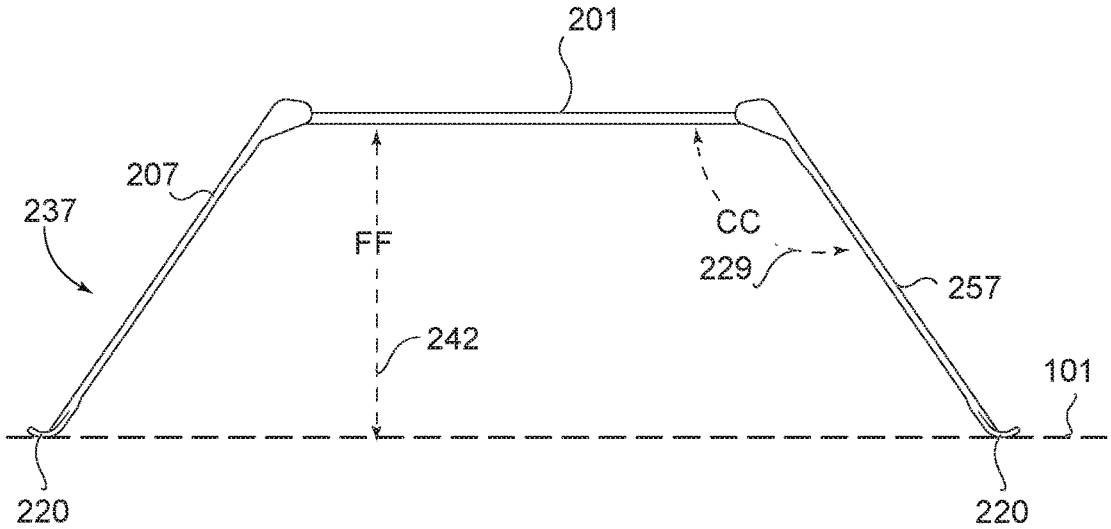
Figure 10C:
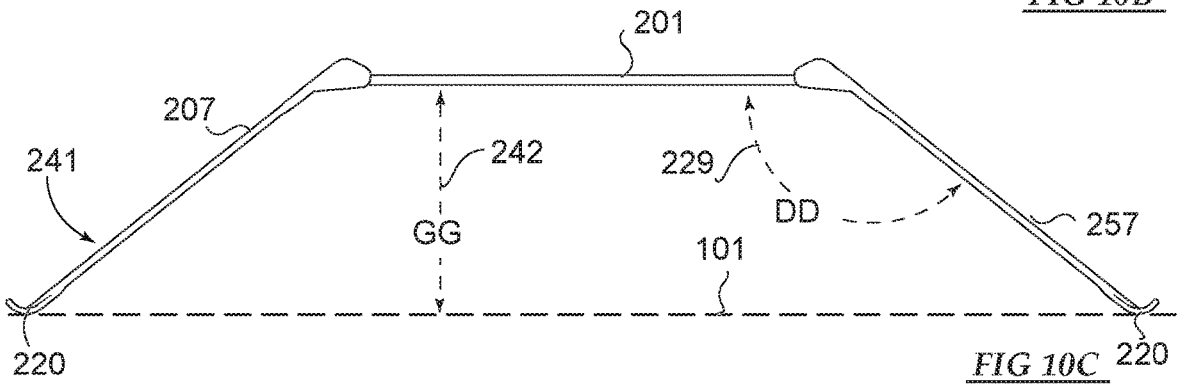

FIG. 10A shows a front view of the hurdle in the first hurdle position 235. As described above the legs 207 are locked at a pivot angle BB. Thus raising the crossbar 201 up to at a height 242 EE from the surface 201. Depending on the length of the legs 207, the height 242 EE preferably ranges from about 10 inches to 20 inches, and more preferably 12 inches. FIG. 10B shows a front view of the hurdle 200 in the second hurdle position 237. As described above the legs 207 are locked at a pivot angle 229 CC, which is more obtuse than angle BB. Thus raising the crossbar 201 up to at a height 242 FF from the surface 101. The height 242 FF preferably ranges from about 7 inches to 13 inches and more preferably about 9 inches from the surface 101. FIG. 10C shows a front view of the hurdle in the third hurdle position 241. As described above the legs 207 are locked at a pivot angle 229 DD, which is more obtuse than angle CC. Thus raising the crossbar 201 up to at a height 242 GG from the surface 101. The height 242 GG preferably ranges from about 4 inches to 8 inches and more preferably about 6 inches from the surface 101.

When the hurdle 200 is in its upright position 203, the hurdle 200 can be used in various exercises. Optionally, the hurdle can be positioned in close proximity to or above the stiles 103, 105 and rungs 107, 107' of the ladder 100. This allows the user to exercise with both the ladder 100 and the hurdles 200. When the rung 107' is used as the crossbar 201 the attachment of legs 207 to rungs 107' can be repeated for the desired number of hurdles 200. The user can then elect to use the rungs 103 in a position close to the surface 101 or in an upright position 205 as a hurdle 200. The hurdles 200 do not have to be connected to the ladder rungs 107, 107' or even in close proximity to the ladder 100. Depending on the exercise, the user may use the hurdles 200 in a different capacity. For example, if the ladder 100 comprises 10 rungs 107,107' the user may elect to have 5 rungs 107,107' spaced apart on the stiles 103, 105. The other 5 rungs 107' may be used to make 5 hurdles 200. The user could then create an obstacle course where the 5 rungs are hopped over doing a side step and then the hurdles 200 are individually jumped after the ladder exercise is completed.

Figure 11:
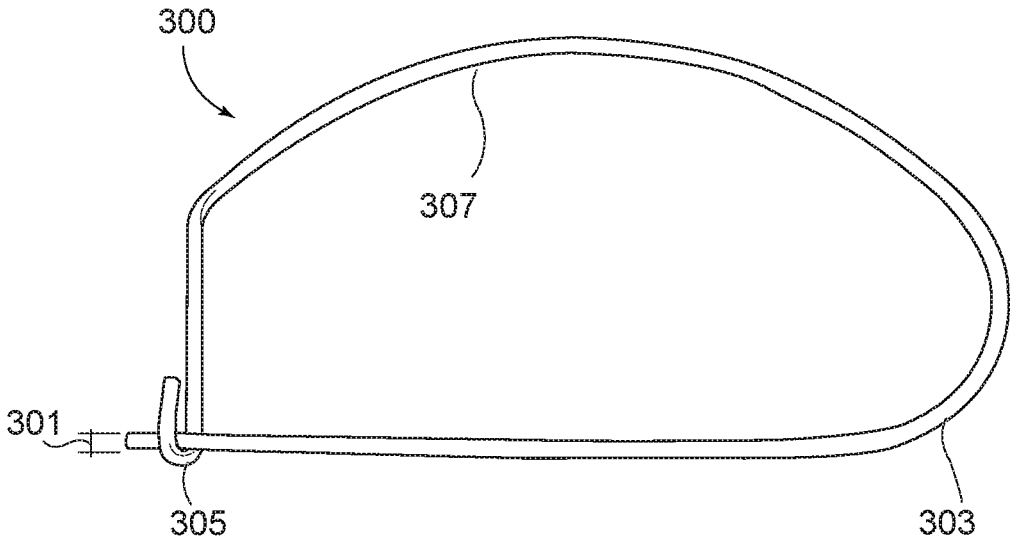
FIG. 11 illustrates a hanger.
Figure 12:
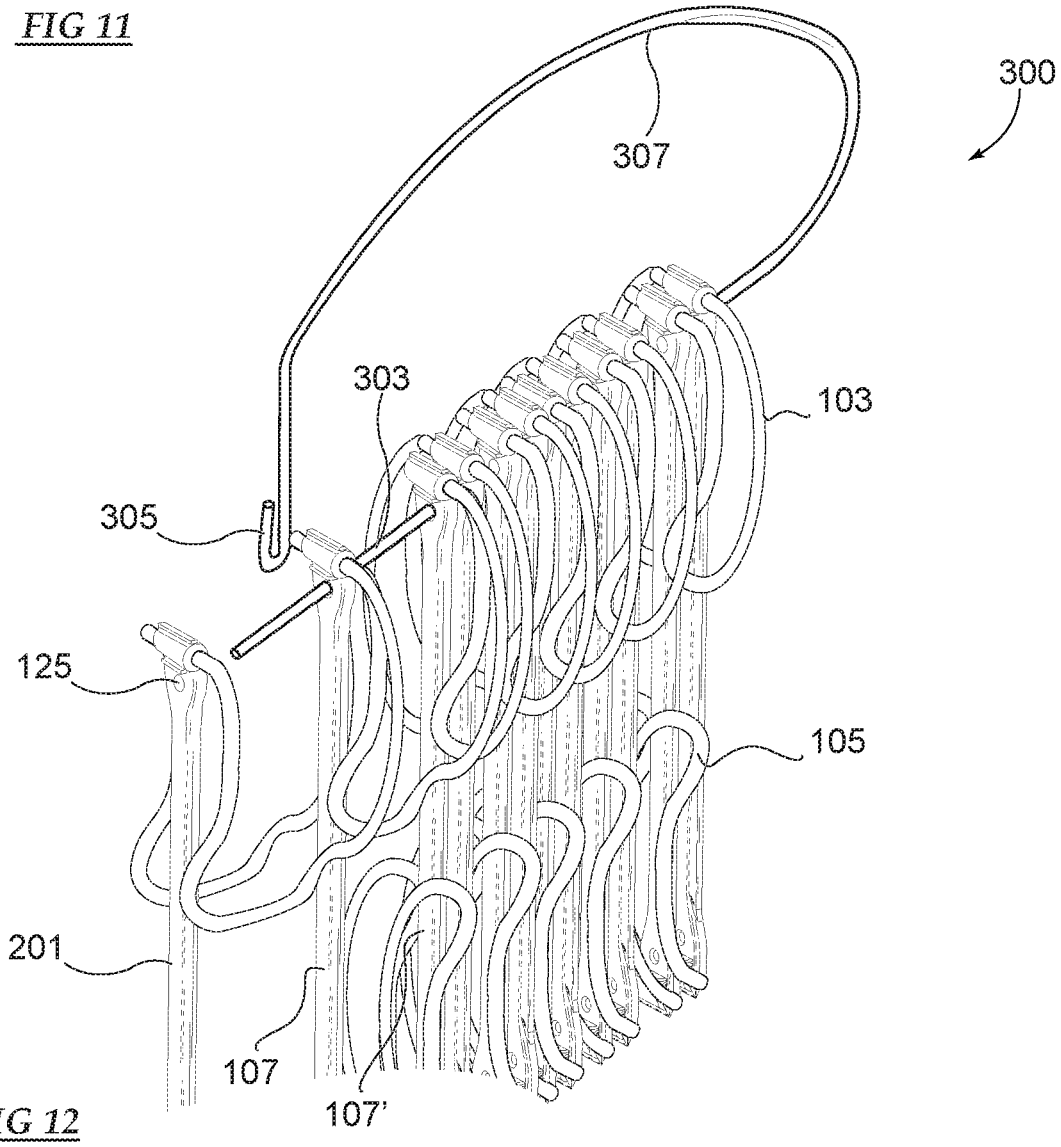
FIG. 12 illustrates a ladder system component mounted on the hanger.

FIGS. 11 and 12 show a storage method. A hanger 300 has a diameter 301 that is less than the diameter of the mounting hole diameter 125. For example, the hanger 300 may include a rod end 303 and a hook end 305, The rod end 303 is inserted through the mounting hole 125 on each rung 107,107', thereby retaining all the rungs 107, 107' and preventing tangling during storage. Hurdles 200 can also be stored on a hanger 300. Each hurdle 200 can have an optional mounting hole 125 so that both the ladder 100 and hurdles 200 can be stored on the hanger 300. In a configuration that includes legs 207, the legs can also have an optional mounting hole 125.

The hanger 300 may have a tightly curved U shape and be made of a springy material, such as steel wire or plastic. The hook end 305 may have a hooked or U shape, allowing for the rod end 303 to be closed and retained inside the hook end 305, and held in place by the spring force of the material, thereby preventing the rungs 107, 107' or other components from sliding off the hanger 300. The hanger 300 may optionally include a handle 307, which can be used for transporting the ladder 100, legs 207 and hurdles 200.

Figure 13:
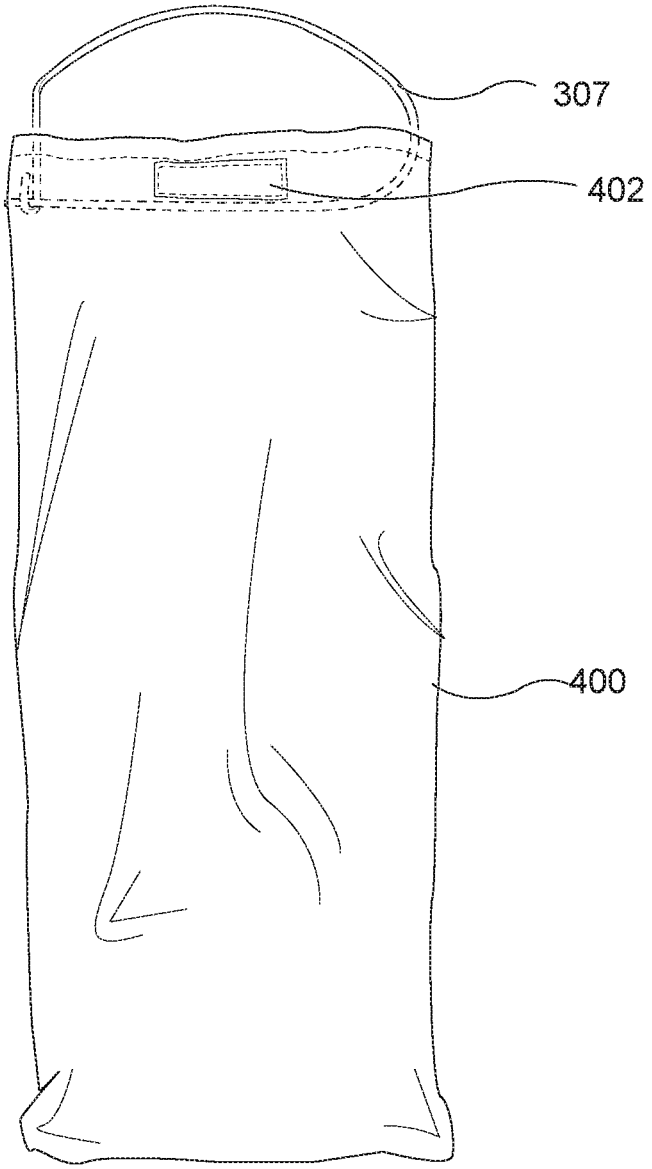
FIG. 13 illustrates an optional package for the ladder system components.

FIG. 13 shows a protective cover 400 for the ladder or the hurdles. The components may be stored in a cover 400, which extends over the rungs 107, 107', legs 207, and hurdles 200. The cover 400 is closed by means of a fastener 402 below the curved handle 307 of the hanger 300, allowing the ladder 100, legs 207 and hurdles 200 to be protected during transport and storage. The fastener 402 may be hook and loop material, a snap, magnet or any other closing mechanism.

In use the ladder 100 is removed from the optional cover 400. The hanger 300 is unlocked and components of the ladder system are removed from the hanger 300. The stiles 103, 105 of the ladder 100 are placed on the exercising surface 101 in an extended position as shown in FIG. 1. The rungs 107, 107' can be repositioned along the stiles 103, 105. Rungs 107' having the clasps 113, 115 can be opened so the rung 107' can be moved along the stiles 103, 105. When the rung 107' is in the desired location the clasps 113, 115 are locked in a closed position thereby securing the rung 107' to the stiles 103,105. This step can be repeated until all of the rungs are in the desired location for the exercise.

Similarly, a hurdle 200 can be removed from a cover 400 and taken off a hanger 300. If the hurdle 200 was stored in the collapsed position 205 the legs 207 are rotated away from the bottom surface of the crossbar 201, placing the distal ends 219 of the legs 207 on the exercising surface 201. The height of the crossbar 201 can be adjusted by changing the pivot angle 229 BB, CC, DD. The user can select the number of hurdles 200 for the desired exercise. The hurdle 200 can optionally be in connection with the ladder 100 or even connected to the rungs 107, 107' by inserting the cutout 221 in the rung ends 109, 111.

In the preferred embodiment, a user can simply remove a rung 107' from the stiles, attach a leg 207 to each rung end 109, 111 and pivotally rotate the legs 207 so that the distal end 219 is placed on the exercising surface 201. Once finished, the user moves the hurdles 200 in the collapsed position 205 by rotating the legs 207 toward the bottom surface of the rung 107' or crossbar 201 so the legs 207 are substantially parallel to the crossbar 201. The stiles 107, 107' of the ladder 100, can be folded by stacking the rungs 107, 107' in a compact arrangement. Optionally, the user can unlock the hanger 300 and insert the rod end 303 through each mounting hole 125 and package the system with a protective cover 400.

Thus, a novel training ladder, hurdle and methods of using the same have been shown and described. While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Although the present invention has been discussed in considerable detail with reference to certain preferred embodiments, other embodiments are possible. Therefore, the scope of the appended claims should not be limited to the description of preferred embodiments contained in this disclosure. It should be emphasized that while the present invention is discussed principally herein in the context of an agility ladder with or without hurdles.

What is claimed:

1. A hurdle comprising:

(a) a crossbar, the crossbar having a top surface, a bottom surface, a first crossbar end and a second crossbar end; and (b) a pair of legs, each leg having a proximal end and a distal end wherein the proximal ends are pivotally connected to the first and second crossbar ends, respectively, wherein in an upright position of the hurdle, the distal ends are configured for placement on an exercising surface, and wherein in a collapsed position of the hurdle, the distal ends are pivoted to be substantially parallel with and folded against a length of the crossbar.

2. The hurdle of claim 1, wherein a height of the crossbar from the exercising surface is adjusted by a pivot angle between the crossbar and the pair of legs, respectively.

3. A method of using a hurdle on an exercising surface, the method comprising the steps of:

(a) selecting the hurdle of claim 1;

(b) rotating the distal ends of the pair of legs respectively away from the bottom surface of the crossbar;

(c) placing the hurdle in the upright position on the exercising surface; and (d) jumping over the hurdle.

4. The method of claim 3, further comprising the step of rotating the distal ends of the pair of legs toward the bottom surface of the crossbar until the pair of legs are substantially parallel to the crossbar, wherein the hurdle is in the collapsed position.

5. A hurdle comprising:

(a) a crossbar, the crossbar having a top surface, a bottom surface, a first crossbar end and a second crossbar end; and (b) a pair of legs, each leg having a proximal end and a distal end wherein the proximal ends are pivotally connected to the first and second crossbar ends, respectively, wherein in an upright position of the hurdle, the distal ends are configured for placement on an exercising surface, and wherein when the hurdle is in a collapsed position, the pair of legs are pivoted such that they lie substantially parallel to the crossbar, with the distal ends of the pair of legs being folded in close proximity to a length of the crossbar.

* * * * *